US009418802B2

(12) United States Patent
Romano et al.

(10) Patent No.: US 9,418,802 B2
(45) Date of Patent: Aug. 16, 2016

(54) SWITCH AUTOMATION DEVICE

(71) Applicant: Switchmate Home LLC, San Ramon, CA (US)

(72) Inventors: Robert Y. Romano, Stanford, CA (US); Tyler Kroymann, Palo Alto, CA (US); Ashish Dua, S. San Francisco, CA (US); Daniel Peng, Pleasanton, CA (US)

( * ) Notice: Subject to any disclaimer, the term of this patent is extended or adjusted under 35 U.S.C. 154(b) by 89 days.

(21) Appl. No.: 14/617,020

(22) Filed: Feb. 9, 2015

(65) Prior Publication Data

US 2015/0228426 A1 Aug. 13, 2015

Related U.S. Application Data

(60) Provisional application No. 61/937,493, filed on Feb. 8, 2014, provisional application No. 62/065,564, filed on Oct. 17, 2014.

(51) Int. Cl.
*H01H 23/14* (2006.01)
*H01H 3/22* (2006.01)

(52) U.S. Cl.
CPC *H01H 23/14* (2013.01); *H01H 3/22* (2013.01)

(58) Field of Classification Search
CPC ..... H01H 23/141; H01H 2221/016; F21V 23/0435; F21V 23/04; H01R 24/76; H01R 13/665; H01R 13/6683
USPC ..... 200/331, 241–242, 333; 174/66–67; 439/536
See application file for complete search history.

(56) References Cited

U.S. PATENT DOCUMENTS

| | | | | |
|---|---|---|---|---|
| 7,214,898 | B1 * | 5/2007 | Margareten | H01H 9/287 174/66 |
| 7,273,983 | B1 * | 9/2007 | Rintz | F21S 8/035 174/66 |
| 8,796,567 | B2 * | 8/2014 | Mahle | G04F 3/025 200/33 R |
| 2009/0020307 | A1 * | 1/2009 | Roach, Jr. | G09F 1/12 174/66 |
| 2015/0244121 | A1 * | 8/2015 | Amelio | H01R 24/78 439/345 |

* cited by examiner

*Primary Examiner* — Edwin A. Leon

(57) ABSTRACT

An automation device to control a pre-existing light switch is described which attaches to the light switch by internal magnets at locations corresponding to the magnetic screw heads of the light switch. This makes installation a simple process requiring no hand tools or electrical connections be made with the light switch. The automation device can be wired or wirelessly controlled and works with both toggle light switches and rocker light switches. Additional functionalities include various timed and automated operations as well as device and user location determinations.

21 Claims, 14 Drawing Sheets

SWITCH AUTOMATION DEVICE

This non-provisional U.S. Patent Application claims priority to, and the benefit of, U.S. Provisional Patent Application No. 61/937,493, filed Feb. 8, 2014, and to U.S. Provisional Patent No. 62/065,564, filed Oct. 17, 2014, the entirety of each of which is hereby incorporated by reference herein.

BACKGROUND OF THE INVENTION

The present invention relates generally to automation of a pre-existing fixture. Specifically, the invention incorporates a novel design for the instant alignment and installation to an existing fixture and the ability to wirelessly actuate a lever on the fixture.

As is known in the art, installing automated switch mechanisms typically requires either physically replacing existing switches, which usually involves snaking changes to existing electrical connections, or plugging an electrical device into the automated switch mechanism which is itself plugged into a wall power plug. This creates impediments to consumer adoption because many are unwilling to make changes to electrical connections or want to control lights and other fixtures connected to an existing switch.

What is needed, therefore, is an automated switch mechanism that avoids such limitations.

SUMMARY OF THE INVENTION

The present invention is an automation device intended to allow users to actuate a pre-existing fixture wirelessly and remotely with minimal installation and alignment. Minimal installation and instant alignment is met, to a great extent, by specific placement of magnets on the backing plate of the device such that they align directly with metallic screws on an existing fixture. As will be further elaborated in the detailed description, the strength of the magnets selected provides the necessary strength to prevent the automation device from detaching during actuation of the existing fixture. Two versions of the invention are presented for pre-existing fixtures with a snap-action lever mechanism as well as for fixtures with a flat, broad lever mechanism which is relatively flush with the fixture. These two versions shall be referred to as version A and B of the automation device, respectively.

In accordance with another aspect of the present invention, version A of the automation device operates with a linear actuator comprising of a rack and pinion mechanism. This mechanism is used to actuate the lever of the pre-existing fixture the automation device is installed on. The pinion is attached to the head of a servomechanism, which operates on a control system to control the position of the pinion and ultimately the rack. Version B of the automation device operates with a rotational mechanism to actuate a broader, flush lever. The chosen servomechanism was selected to be able to provide an adequate amount of torque and range of motion to toggle levers of both types.

In accordance with still another aspect of the present invention, the automation device includes a system to allow for wireless control of the said gear-based system. More specifically, the system includes a Bluetooth Low Energy (BLE) wireless module, allowing for wireless control of the device from other devices operating on this protocol.

In accordance with still another aspect of the present invention, the automation device includes a microcontroller to communicate with the said wireless module of the said gear-based system to handle logic for timers, proximity detection, and schedules.

In accordance with still another aspect of the present invention, the automation device can send data to and from an external wireless gateway device containing Wi-Fi and BLE modules, allowing for control and status information of the devices from a remote location. The wireless gateway is not necessary for the operation of the present invention, as it mainly serves to increase the range of the automation device. These wireless gateways may include, but are not limited to, personal computers, smart phones, and tablet devices.

BRIEF DESCRIPTION OF THE DRAWINGS

The accompanying drawings provide visual representations which will be used to more fully describe the representative embodiments disclosed herein and can be used by those skilled in the art to better understand them and their inherent advantages. In these drawings, like reference numerals identify corresponding elements and:

FIG. 11 shows the rotational head for version B of the present invention and the servomechanism it attaches to.

DETAILED DESCRIPTION

The present invention serves as an automation device to toggle a lever on a pre-existing fixture by both a button input on the automation device as well as wirelessly from any device capable of communicating on the same wireless communication protocol. These devices may include, but are not limited to, personal computers, smart phones, tablet devices, and wireless gateways. As an example of a pre-existing fixture this device may operate with, version A and version b of the automation device are capable of automating toggle 101 and rocker 201 switches, respectively.

Figure 3:
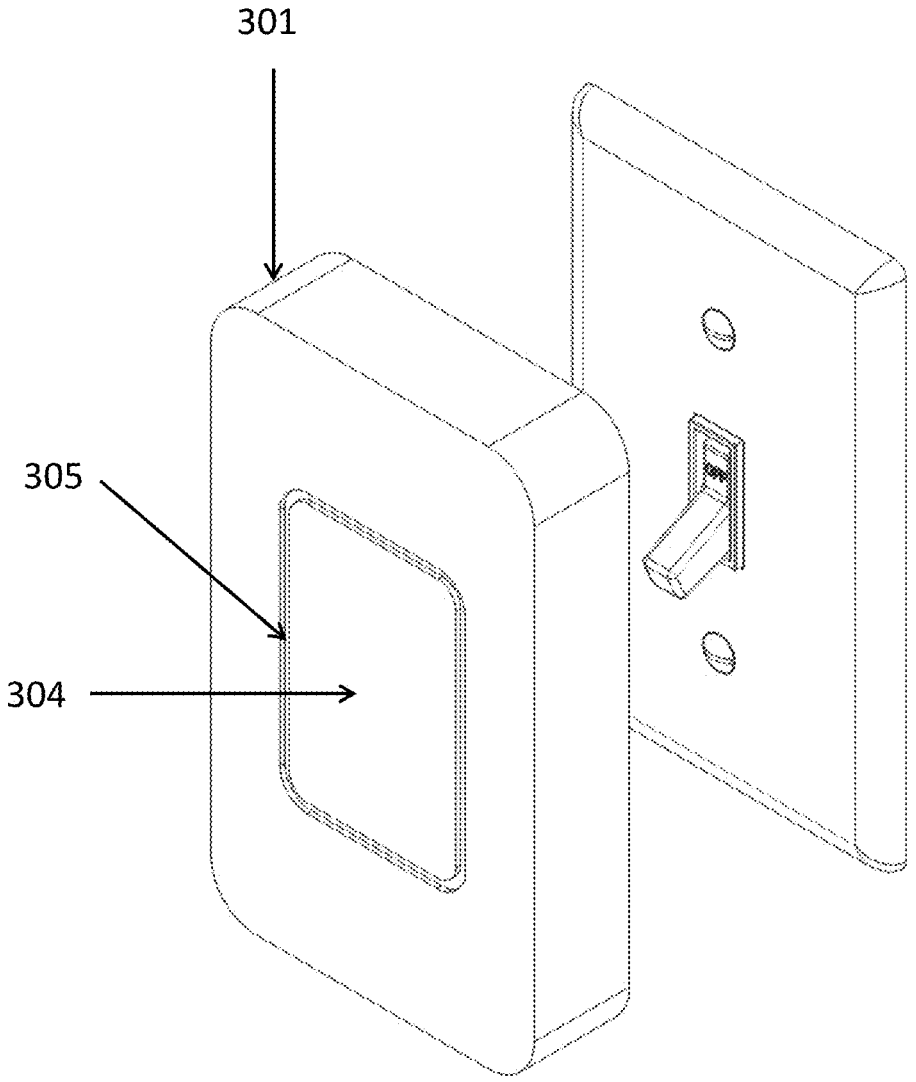
FIG. 3 shows the front cover of version A of the present invention in the orientation in which it would attach to a toggle switch.

Referring now to the invention in more detail, in FIG. 3 there is shown the front cover 301 of version A of the present invention and a button input 304. This button input 304 serves as manual method of actuating the lever on the pre-existing fixture as well as providing tactile feedback to the user. The button does not actuate the lever, but rather serves as an input on the internal circuitry which in turn activates the servomechanism to toggle the lever 102 from its previous position. Once the automation device has been installed, the two interfaces to toggle the lever on the pre-existing fixture are through the button input 304 and by a wireless command. In both instances, the microcontroller 502 receives an input and activates the servomechanism 509. As such, the microcontroller 502 is able to keep track of the state of the lever based on the previous command, forgoing the need of a sensor for this state-tracking. The metal screws 104 on the pre-existing fix hire serve as the attachment points for the magnets 402 on the automation device.

Figure 8:
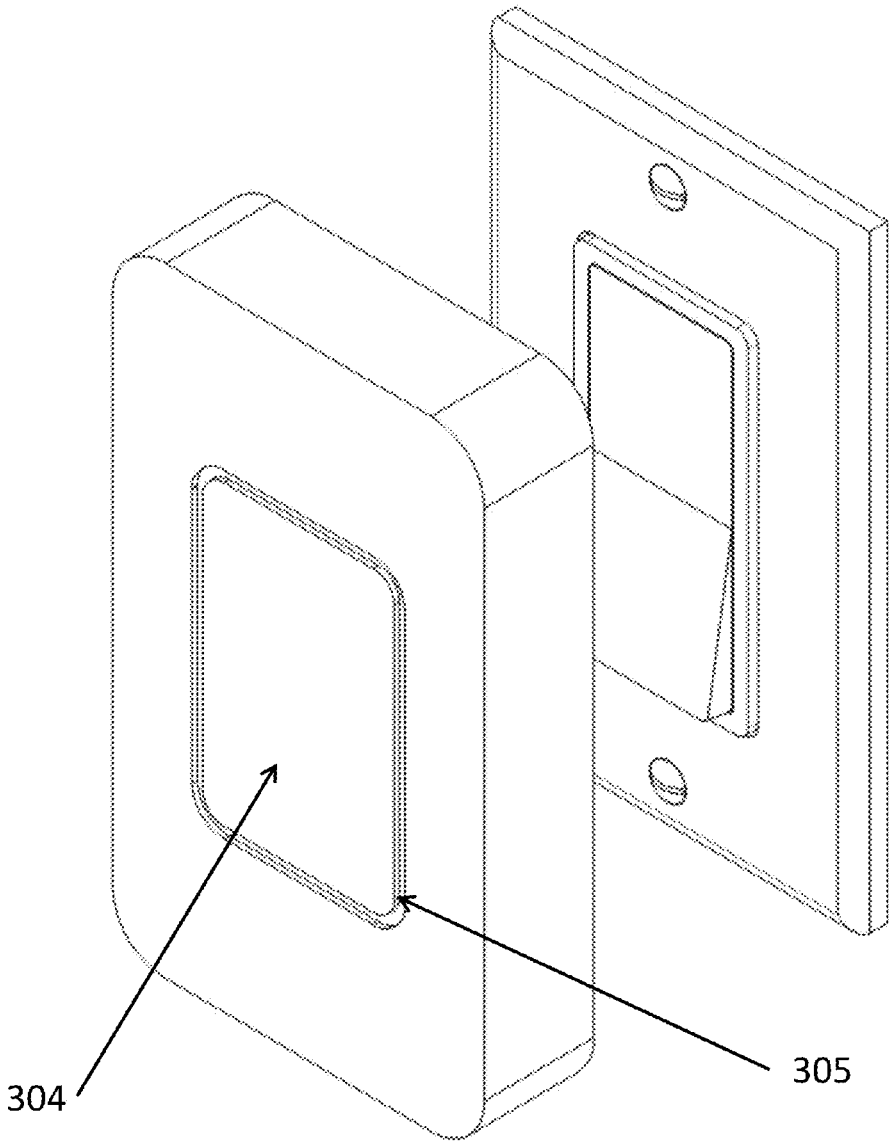
FIG. 8 shows the front cover of version B of the present invention in the orientation in which it would attach to a rocker switch.

Surrounding the button is a ring 305 of photo-luminescent material intended to improve visibility of the device in poorly lit environments. FIG. 8 depicts an analogous view for version B of the device for a broader, flat lever 202 on the rocker switch with metal screws 104 at a different spacing. The magnets 402 on version B of the device are spaced apart to directly contact these metal screws. The button input 304 and the photo-luminescent material 305 remains the same as version A of the device.

Figure 4:
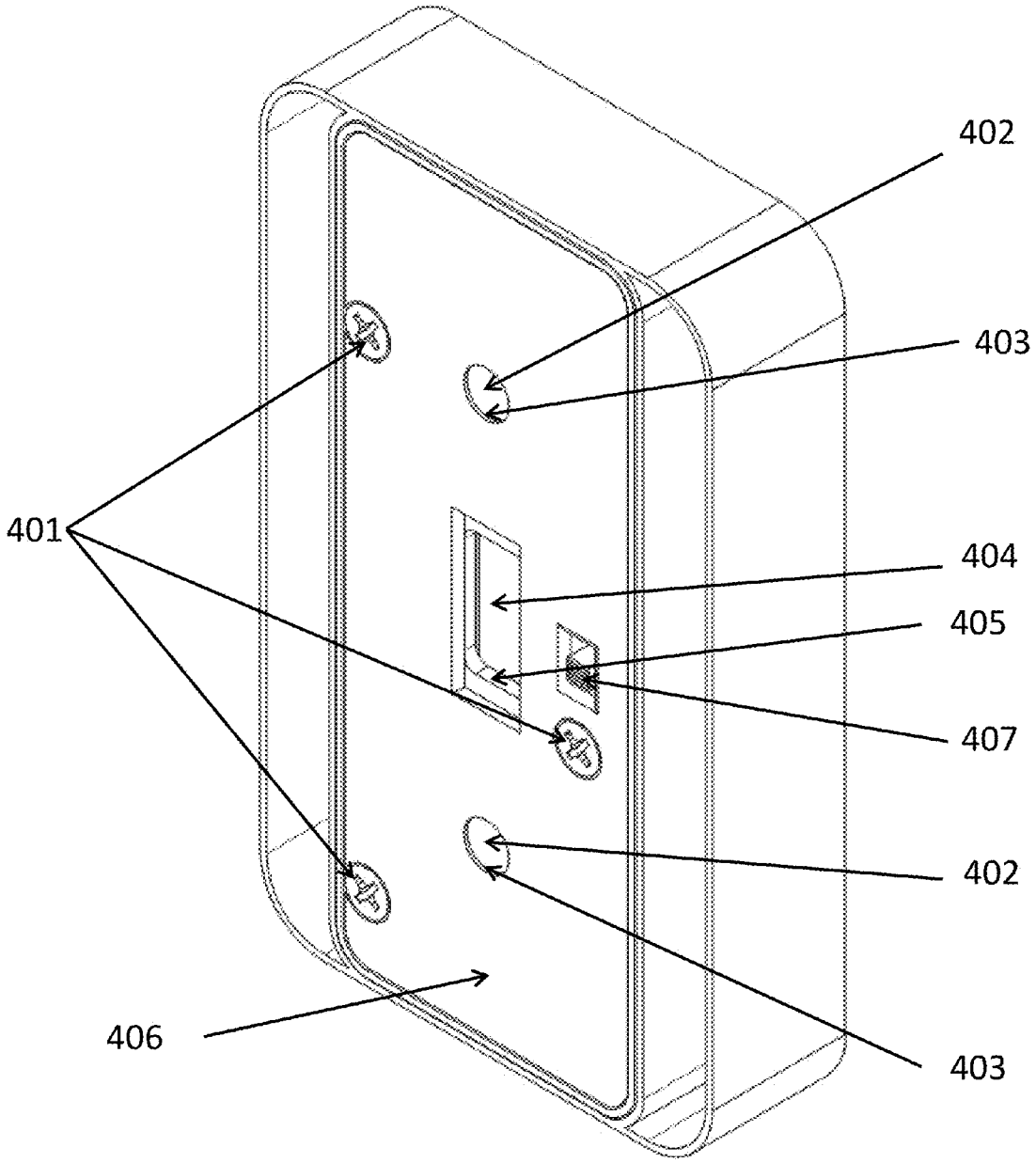
FIG. 4 shows the posterior view of version A of the present invention.
Figure 9:
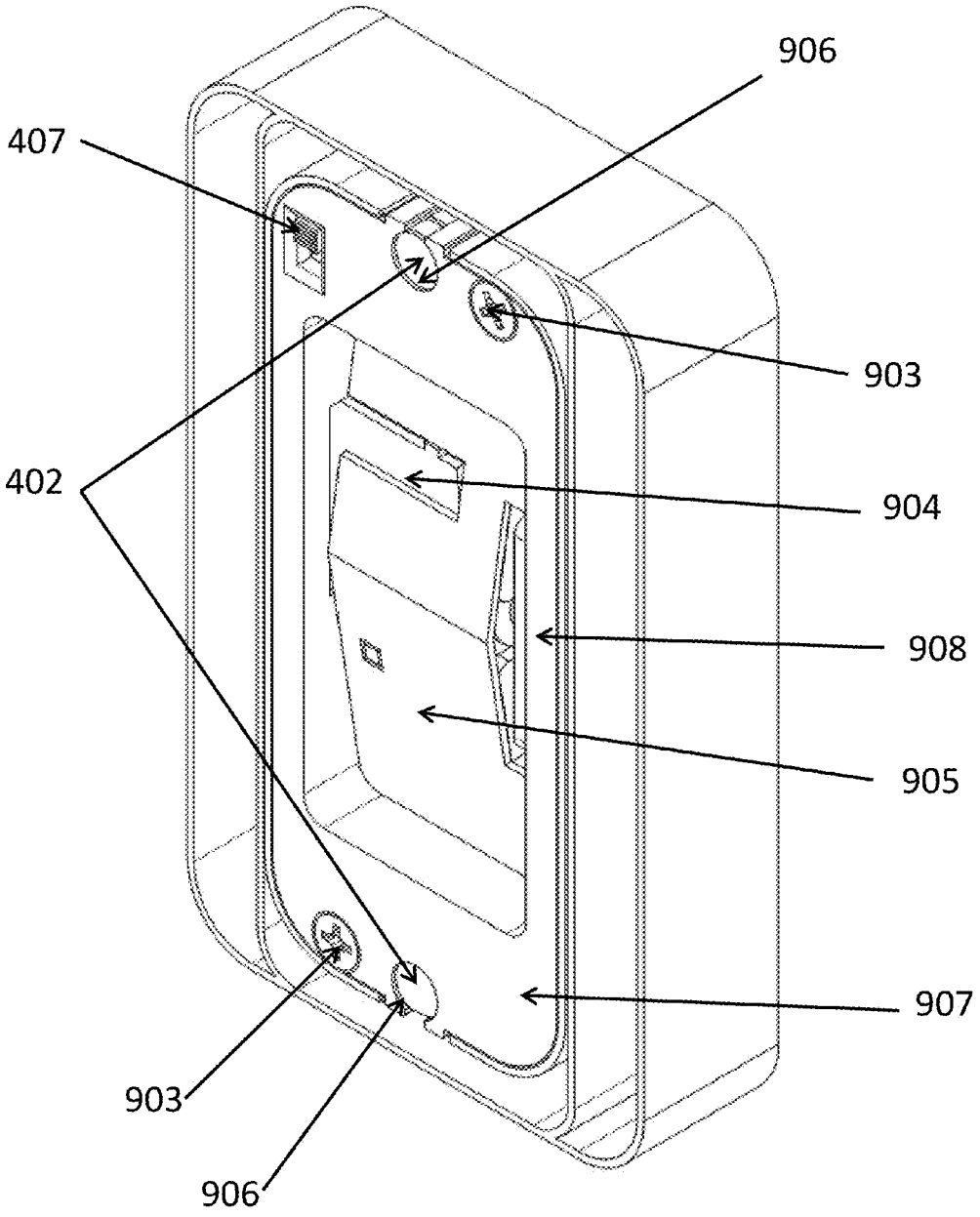
FIG. 9 shows the posterior view of version B of the present invention.

In FIG. 4 a posterior perspective is shown of version A of the automation device with the backing plate 406 attached. The backing plate 406 includes two apertures 403 with chamfered edges around the magnets 402, spaced apart to match the placement of metal screws 104 of the pre-existing fixture shown in FIG. 1. A rectangular aperture is present 404 on the backing plate to allow for the lever of the pre-existing fixture to protrude through and be actuated by the internal rack 405. Similarly, in FIG. 9 a posterior perspective is shown of version B of the automation device with the backing plate 907 attached. Two apertures 906 with chamfered edges surround magnets 402, spaced apart to match the placement of the metal screw 104 of the pre-existing fixture shown in FIG. 2. This Chamfered geometry improves the alignment of the automation device as it matches hemispherical heads of screws commonly present on toggle and rocker switches.

Figure 1:
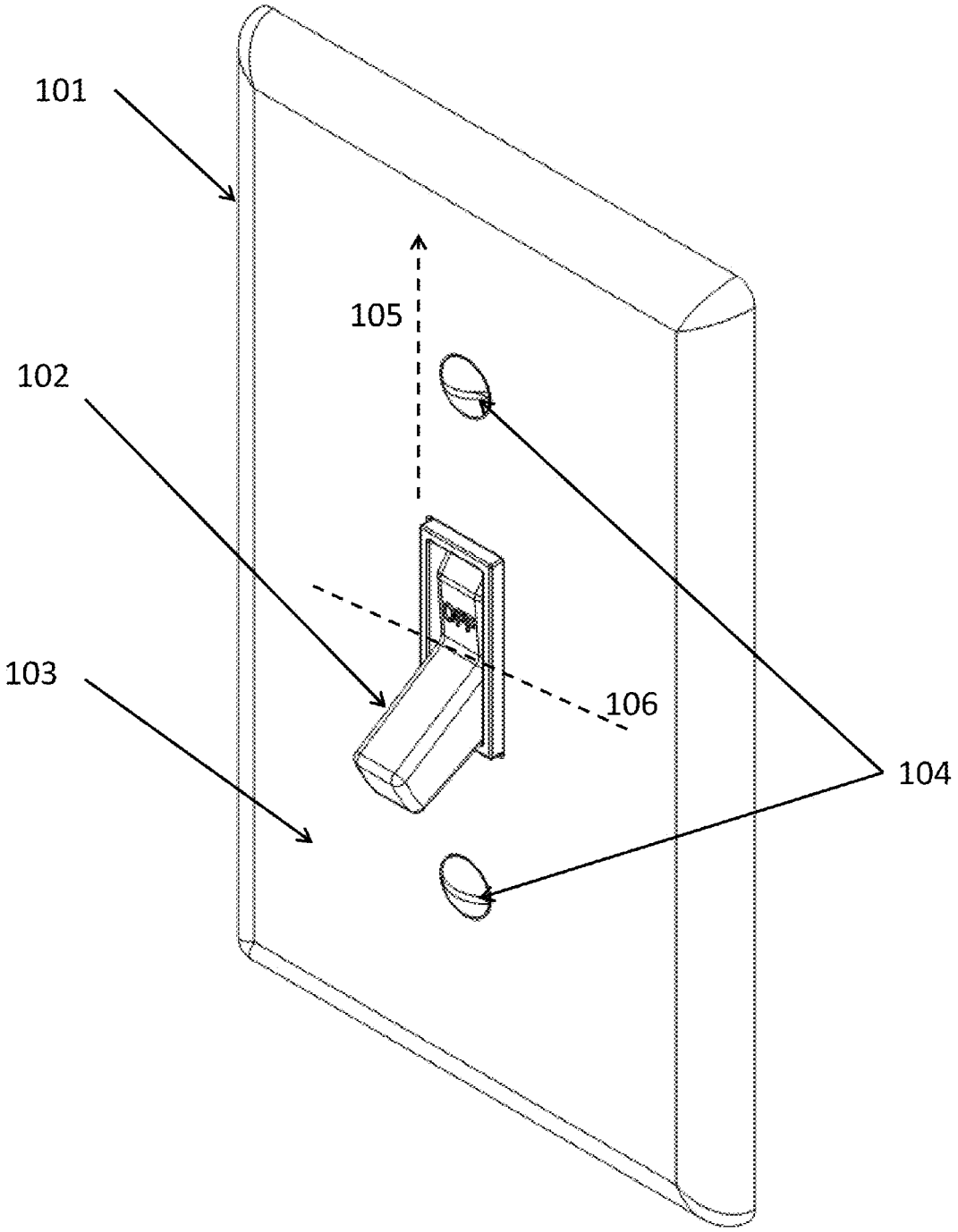
FIG. 1 shows a standard toggle switch, an example of a pre-existing fixture version A of the present invention could automate.
Figure 2:
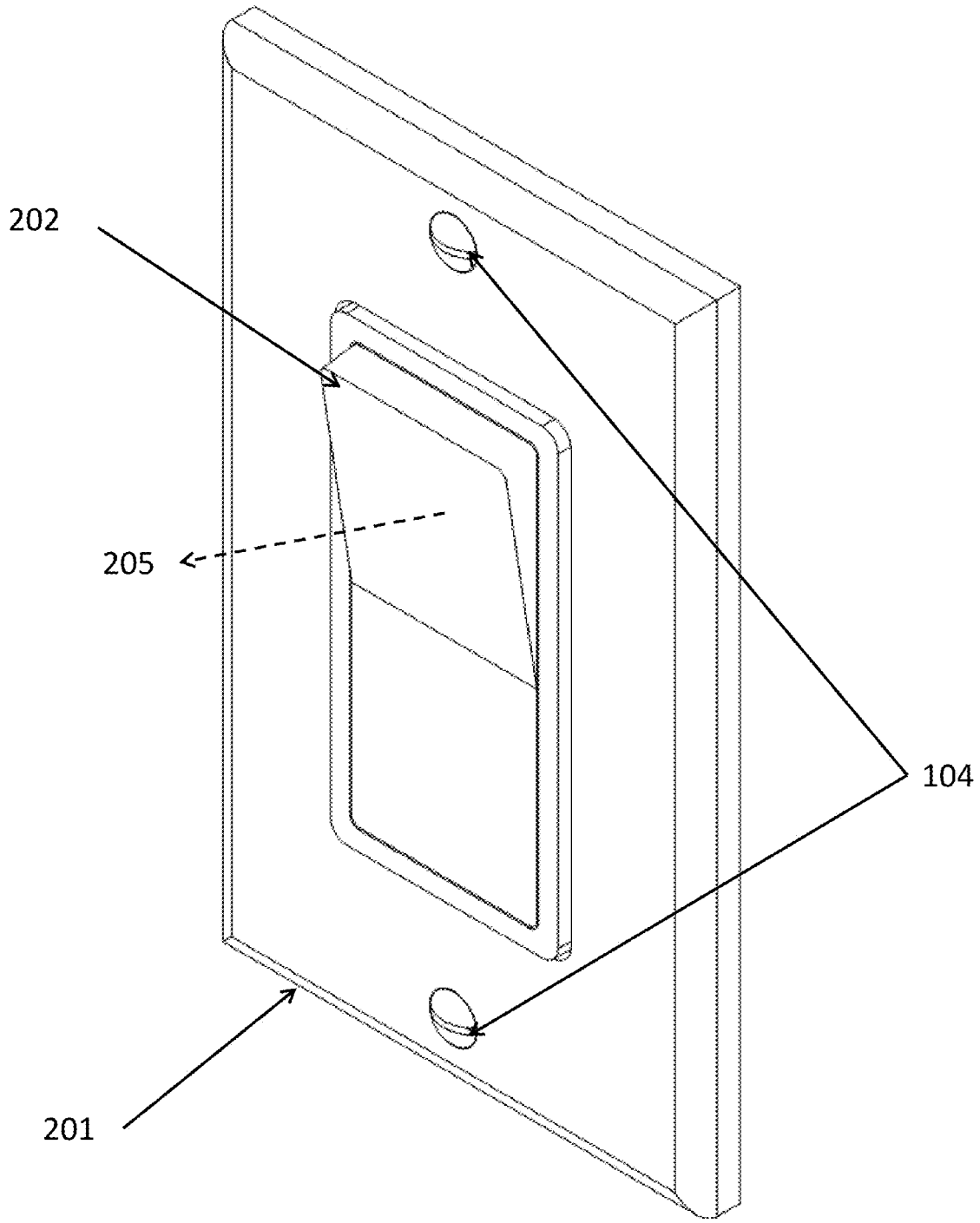
FIG. 2 shows a standard rocker switch, an example of a pre-existing fixture version B of the present invention could automate.

For the version A of the automation device, as the automation device actuates the lever 102 on the toggle switch in the direction 105 shown in FIG. 1, an equal but opposite force in this plane, parallel to the surface 103 of the toggle switch, is produced due to the internal spring of the toggle switch. To counter this force and prevent the device from moving during actuation, a material 708 capable of providing sufficient frictional farce is coated on the backing plate 406. The backing plate 907 for version B of the device also includes this material on its surface 908. Sufficient frictional force is met by the material providing a frictional force between the backing plate and the surface of the pre-existing fixture such that the frictional is force greater than or equal to the force required to actuate the lever on the pre-existing fixture. In the example of a toggle switch, this would be approximately 2.5 pounds. A material capable of providing this frictional force would also be sufficient for a rocker switch 201 since the force generated during actuation for this type of switch is primarily orthogonal to the surface of the switch, as depicted in FIG. 2 in direction 205. Examples of this coating can include, but are not limited to, polyurethane and silicone. However, a permanent coating need not be used; an alternative solution could include a temporary or pressure sensitive adhesives such as rubber, standard acrylic, and silicone on the backing plate. A toggle switch 407 for version A and version B of the present invention is used to power the automation device on and off.

Figure 5:
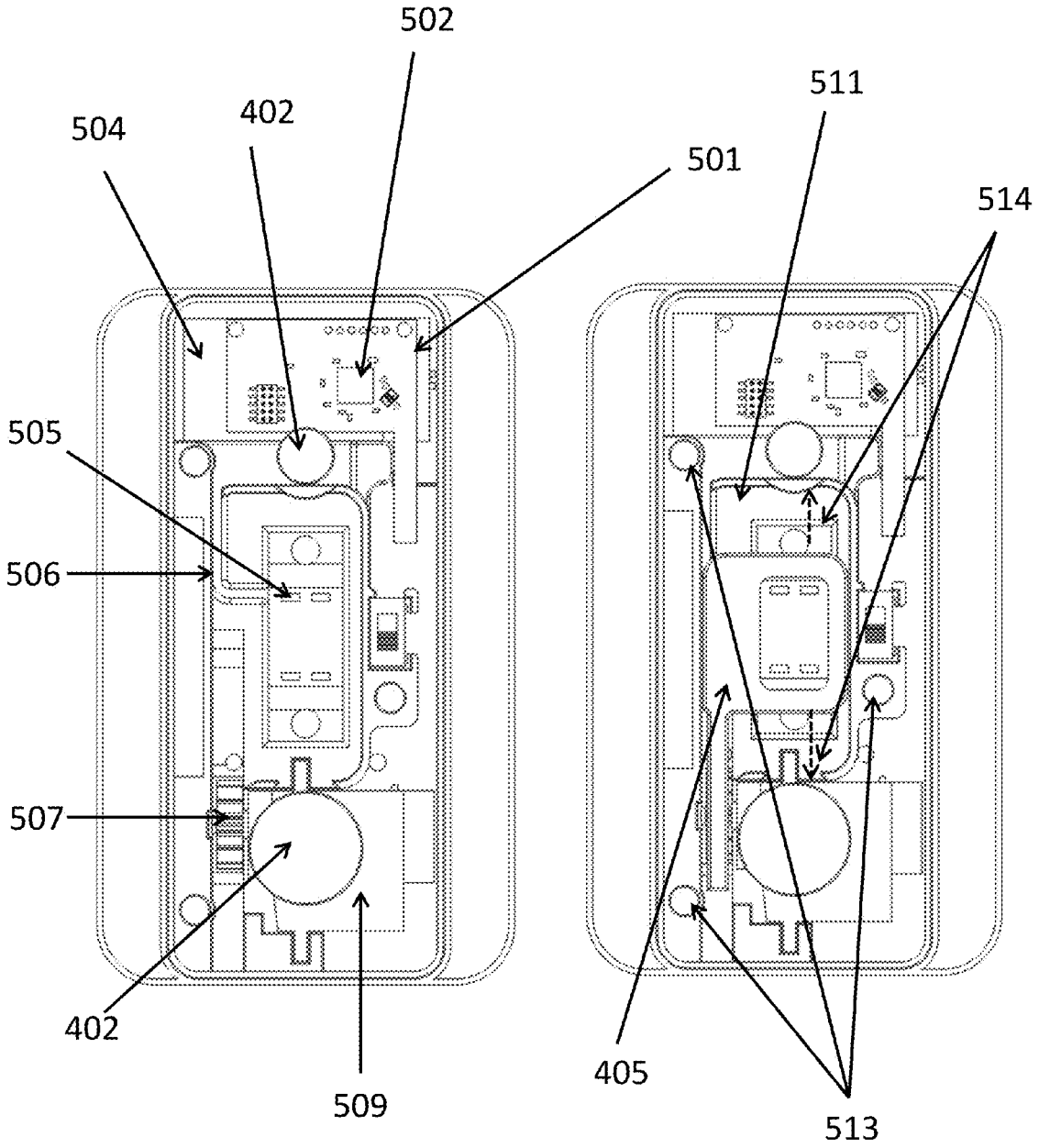
FIG. 5 is an internal view of version A of the present invention.
Figure 10:
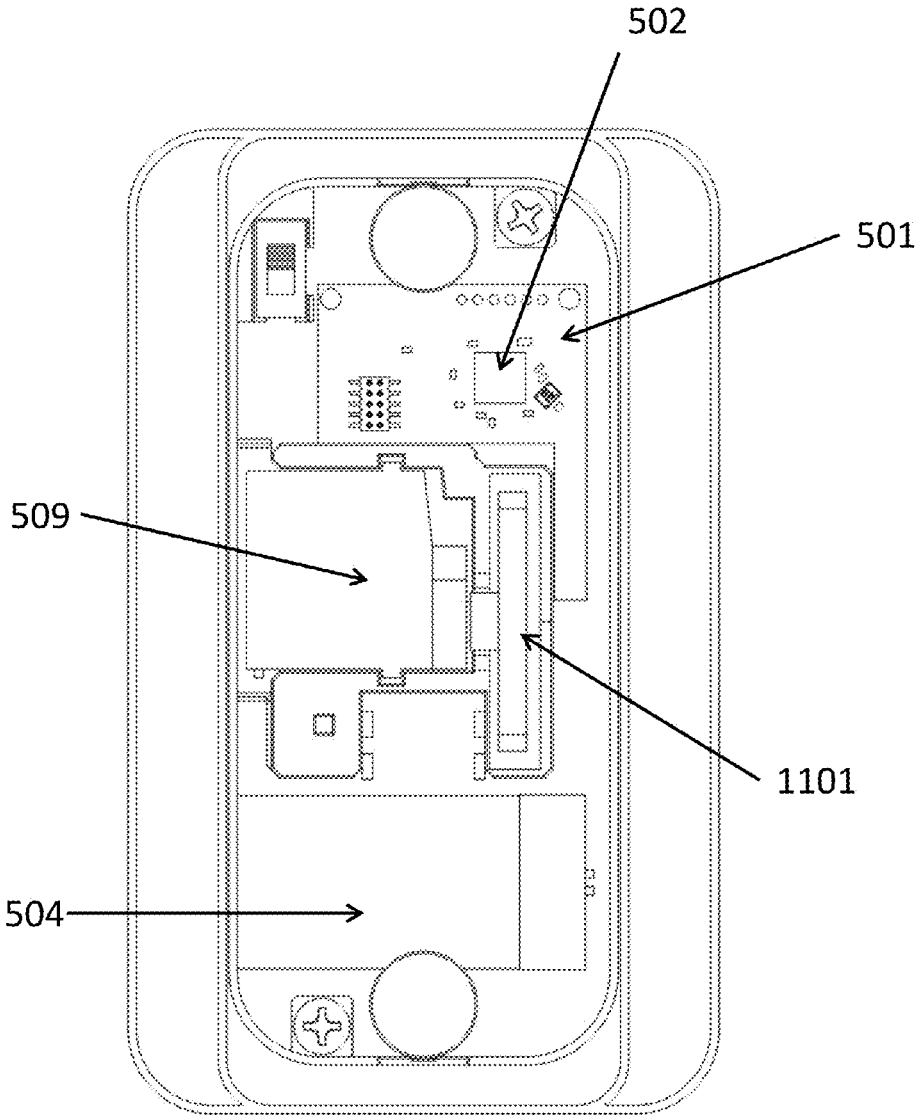
FIG. 10 shows the internal view of version B of the present invention.

FIG. 5 depicts the interior of the front cover for version A and FIG. 10 depicts the interior of the front cover for version B of the automation device, holding many of the internal components. Specifically for version A, holes 513 for the screws meant to attach the back plate 406 are shown as well as a path 505 to guide wires from the button input 304 is shown. A filleted track 511 is made to provide a guiding track for the motion of the rack 405 as it is actuated by the pinion 507 on the head of the servomechanism 509 in two directions 514.

Figure 6:
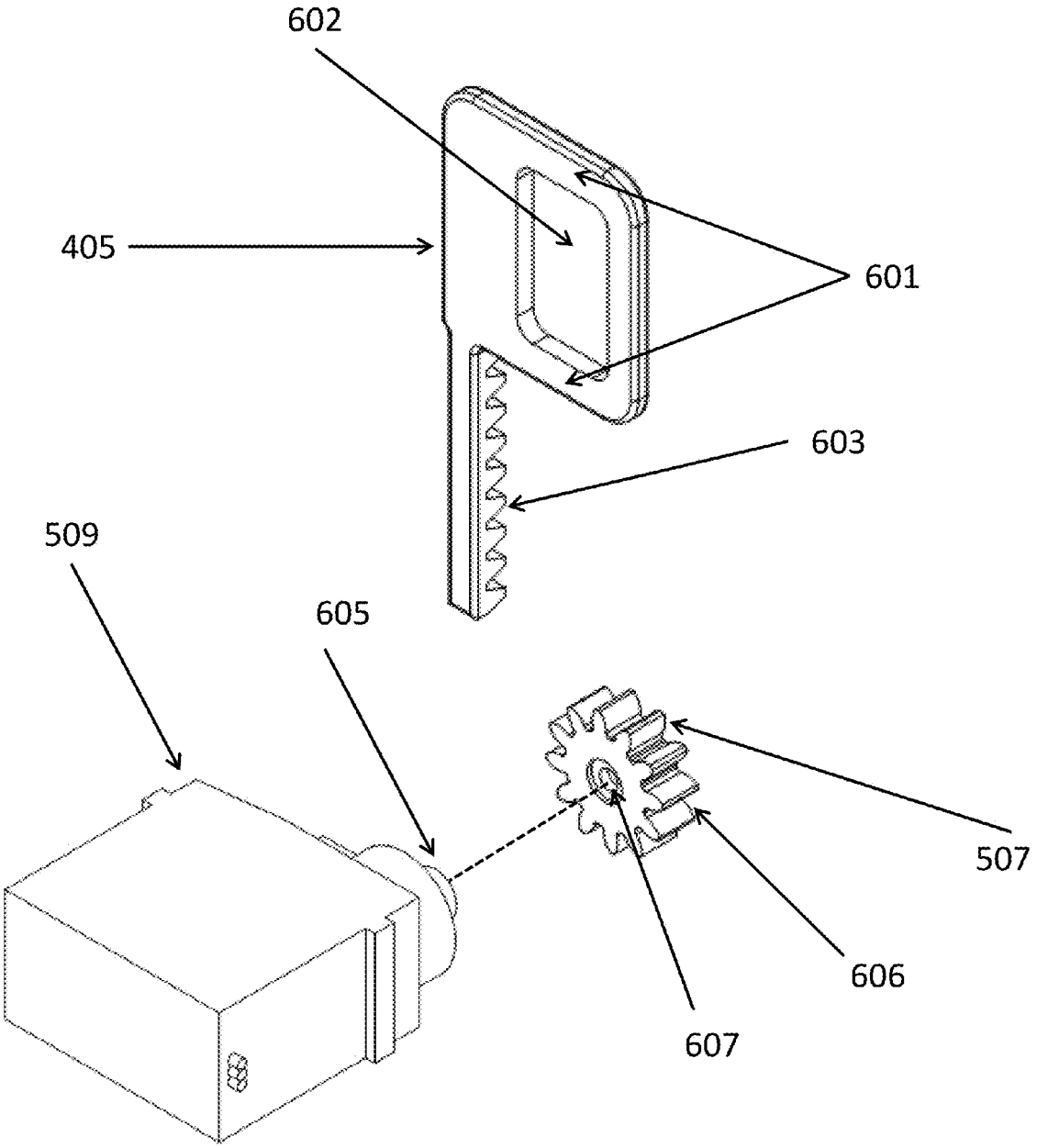
FIG. 6 is perspective view of the rack, pinion, and servomechanism for version A of the present invention.

FIG. 6 shows the rack 405 and the pinion 507 for version A of the automation device in greater detail. The rack contains an aperture 602 to allow the lever 102 of the pre-existing fixture to protrude through. The teeth 603 of the rack match the teeth 606 of the pinion 507 to allow for smooth actuation. A small aperture 607 on the pinion allows it to be held in place onto the servomechanism head 605 with a screw. In this rack and pinion configuration, a servomechanism was selected to provide sufficient torque. The rack actuates the lever 102 of the toggle switch at approximately 0.2 inches from the surface 103 of the toggle switch. As stated previously, typical toggle switches require approximately 2.5 pounds to flip. Thus, sufficient torque is met by being able to provide a minimum peak force of 2.5 pounds at a lever arm distance of 0.2 inches. In this scenario, the servomechanism must have a torque output exceeding 0.5 lb-in.

Figure 11:
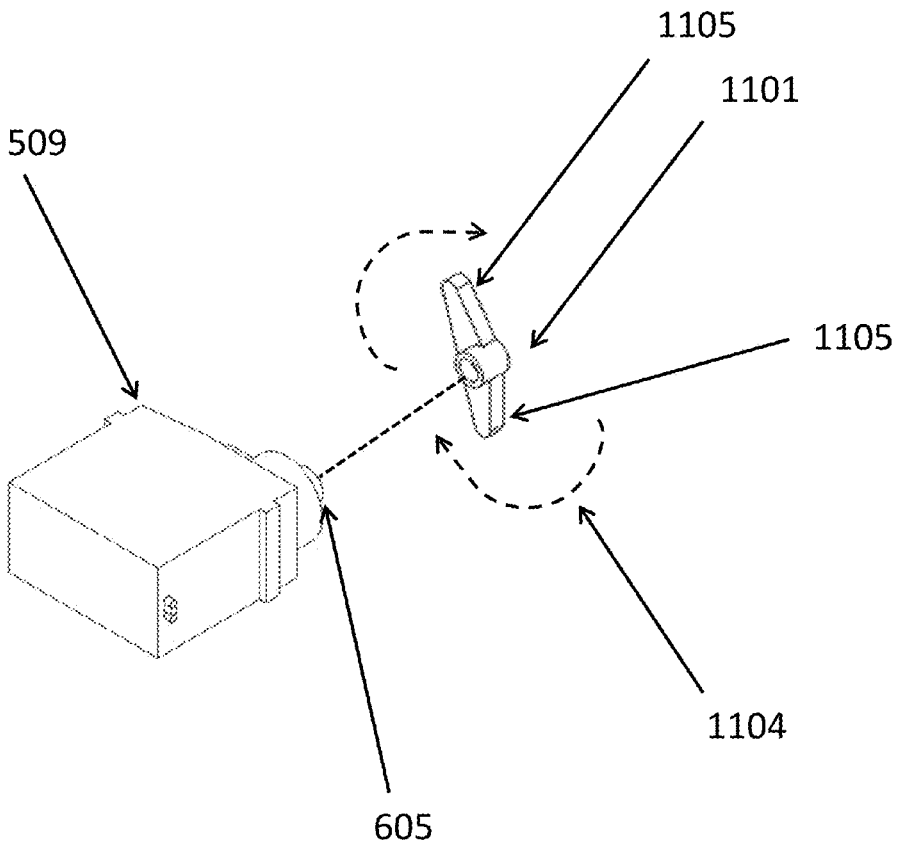

Version B of the automation device actuates a broad, flat lever switch and therefore has different torque requirements. FIG. 11 depicts the rotational head 1101 as well as the head 605 of the servomechanism it attaches to. This rotational head has a rotational motion 1104 which allows the fins 1105 of the rotational head to directly contact the lever 202 of the rocker switch. These fins can protrude through an aperture 1203 the backing plate 907 to make contact with the rocker switch. Typical rocker switches require 1 pound of force to toggle and the fins 1105 create a lever arm distance of approximately 0.9 inches, creating a torque requirement of 0.19 lb-in for the servomechanism.

For both types of switches, there is energy lost clue to friction and the torque is not applied directly orthogonally. To compensate for this, a safety factor of approximately 1.5× was incorporated and a servomechanism with a torque output of 1.4 lb-in was selected.

The version A and version B microcontroller 502 on the circuit hoard 501 contains logic for scheduling timers, proximity detection, and range of motion. Timers can be set by wireless commands using devices such as smart phones, personal computers, and tablets. The firmware implementation on the microcontroller allows these timers to be recurring on a daily, weekly, and monthly basis. Random number generators within the microcontroller also allow for the randomization of these timers. The wireless module is also able to detect proximity of another device operating on the same wireless protocol using on-board hardware capable of measuring received signal strength. This value, known as received signal strength indicator (RSSI), is a measurement of power received by the antenna on the wireless module. As another wireless device is brought closer to the antenna, the power received would also increase, providing a means of measuring an approximate distance between devices. Using this value, logic can be implemented on the microcontroller is able to activate the servomechanism to change the state of the lever on the pre-existing fixture. As an example, a user can create a setting with a smartphone to have the automation device change the state of the toggle switch to "on" when the user is within range. The microcontroller on the automation device can use logic such that when the RSSI value is greater than or equal to −80 dBm, the microcontroller will activate the servomechanism to flip the toggle switch to the "on" position. The user would then be able to have lights turn on automatically without needing to explicitly send a command upon entering the home. The RSSI value which serves as the threshold for an actuation event to occur can be set by the user or a default value can be used based on needed sensitivity and range. The microcontroller logic for actuating the servomechanism is explained in the subsequent paragraphs.

In FIG. 5, version A of the internals of automation device is shown with the rack 405 in the center position. The pinion 507 below the rack 405 is able to rotate from 0-180° by the servomechanism 509. Upon power-up of the device, the microcontroller provides a pulse width modulated signal to the servomechanism to move the servo head to the center position (90° position) and move the rack 405 to the center position of the fillet 511. This center position is denoted the "90° position" of the pinion 507. This center position ensures that the rack does not interfere with the lever 102 on the pre-existing fixture 101 during installation. FIG. 4 depicts the posterior of the device with the backing plate when the rack is in the center position. When a command is received to actuate the lever on the pre-existing fixture, a PWM (pulse width modulation) signal is sent for 350 milliseconds corresponding to either the 0° position or 180° position, moving the rack 405 to the top or bottom of the filleted track 511, respectively. During this actuation, the lever 102 protrudes through the aperture 602 of the rack 405. As the rack moves, the edges of the rack 601 come in contact with the lever 102 and exert a force on the lever in a direction parallel to the surface 103 of the toggle switch. Toggle switches have an inherent spring which returns them to their previous state if the lever 102 is not moved beyond the center axis 106. To counter this spring action and prevent false flips, the microcontroller returns the rack 405 to an offset position from end positions (0° or 180°). This is done by the microcontroller first providing a PWM signal for 350 milliseconds corresponding to 0° or 180°, depending on the command received. Due to the variability of the thickness of the lever 102 on toggle switches, in these positions (0° or 180°), the rack may be in a state where it is exerting torque on the lever but the lever cannot move any further. In this state, the servomechanism is at stall and can be damaged should it remain in this state. After the microcontroller has provided a PWM signal for 350 milliseconds, the microcontroller provides a second PWM signal for 100 milliseconds corresponding to a 10° offset from these end state positions (10° or 170°). This returns the rack to a state where the edges 601 are no longer in contact with the lever 102 on the toggle switch.

For version B of the device, the microcontroller also supplies a PWM signal but has a closed loop control system based on the current consumption of the servomechanism. The torque generating component of a servomechanism is a DC motor. For a DC motor, the current drawn is directly proportional to the torque output of the motor. Motor current at stall and various loads can be measured experimentally or retrieved from a data sheet. Therefore, by measuring motor current it is possible to detect when the DC motor inside the servomechanism has stalled. Current consumption of the servo is measured by the voltage drop across a shunt resistor in series with the power line of the servomechanism. This voltage drop is amplified such that the stall current of the servo corresponds to 90% the maximum value the ADC (analog to digital converter) on the microcontroller is capable of measuring. As the servomechanism actuates the rocker switch, the current increases, due to increasing load, until it has completely flipped the switch. Once the rocker switch cannot move any further, the servomechanism reaches the stall current. The microcontroller is able to detect this stall by the ADC measurement and the microcontroller supplies a PWM signal to return the rotational head 1101 to the state depicted in FIG. 10, parallel to the surface of the backing plate 908. This feedback system prevents the servomechanism from actuating the rocker switch after it has already been toggled and prevents the motor from remaining in a stalled state. During actuation of the rocker switch, an equal but opposite farce is generated in an orthogonal direction 205 to the surface of the switch. As mentioned earlier, this force is approximately 1 pound. Therefore the magnets 402 on version B of the must be able to provide at minimum this attachment force. To improve the attachment integrity of the device, neodymium magnets (N52) 402 were selected such that there was a safety factor exceeding 5× (5 pounds of pull force) and the dimensions were constrained such that the magnets did not come into contact with any internal components or increase the thickness of the automation device overall.

Figure 7:
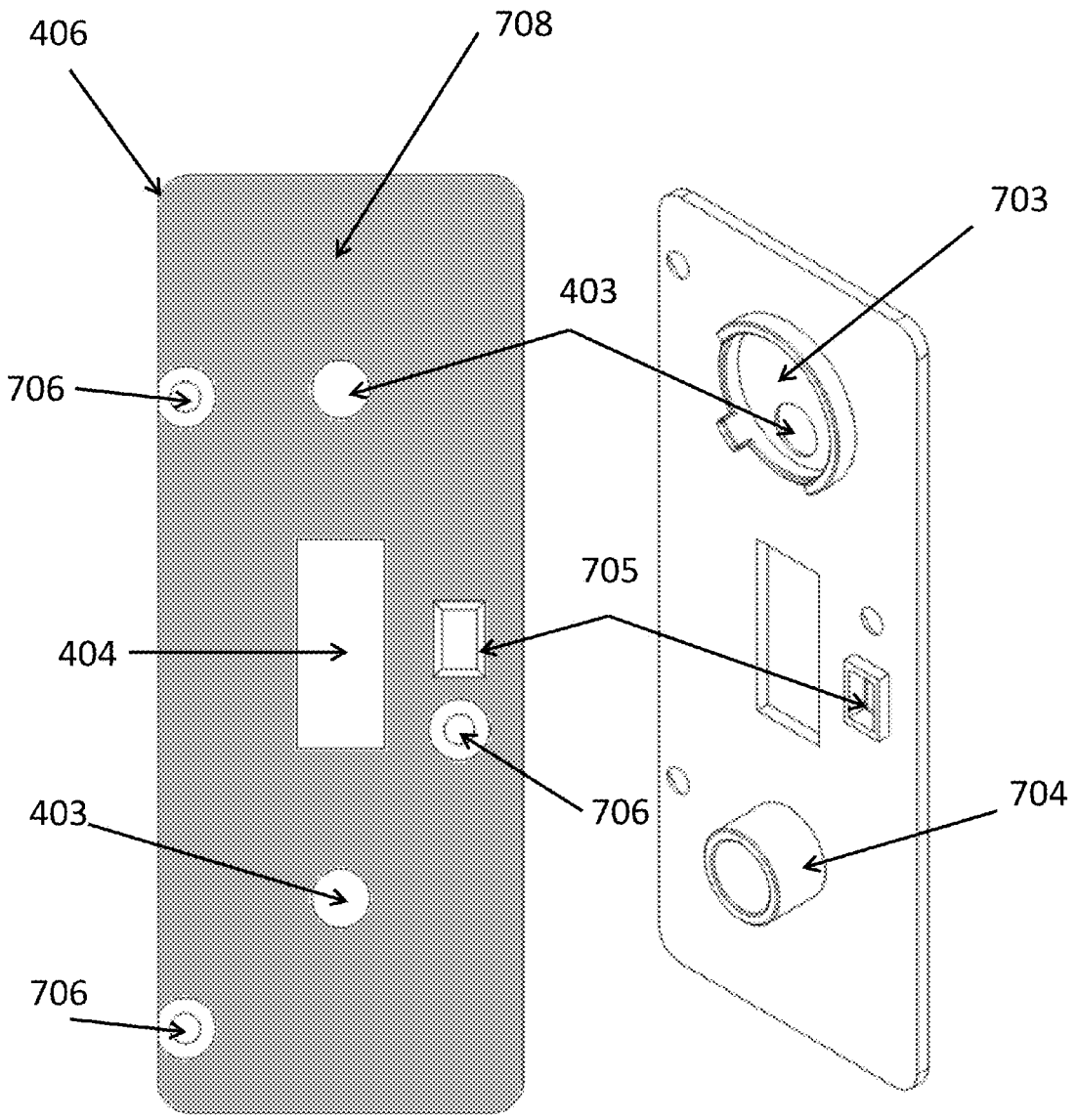
FIG. 7 is a posterior and perspective view of the back cover for version A of the present invention.

FIG. 7 shows a posterior and perspective view of the backing plate 406 for version A of the present invention. Three apertures 706 allow this backing plate to be mounted onto the frontal cover with screws, although this need not be the only mechanism of attachment. A weld or adhesive could also be used for attachment. Compartments 703 and 704 house neodymium magnets; apertures 403 within these compartments to allow the magnets to directly contact metal screws on the pre-existing fixture.

Figure 12:
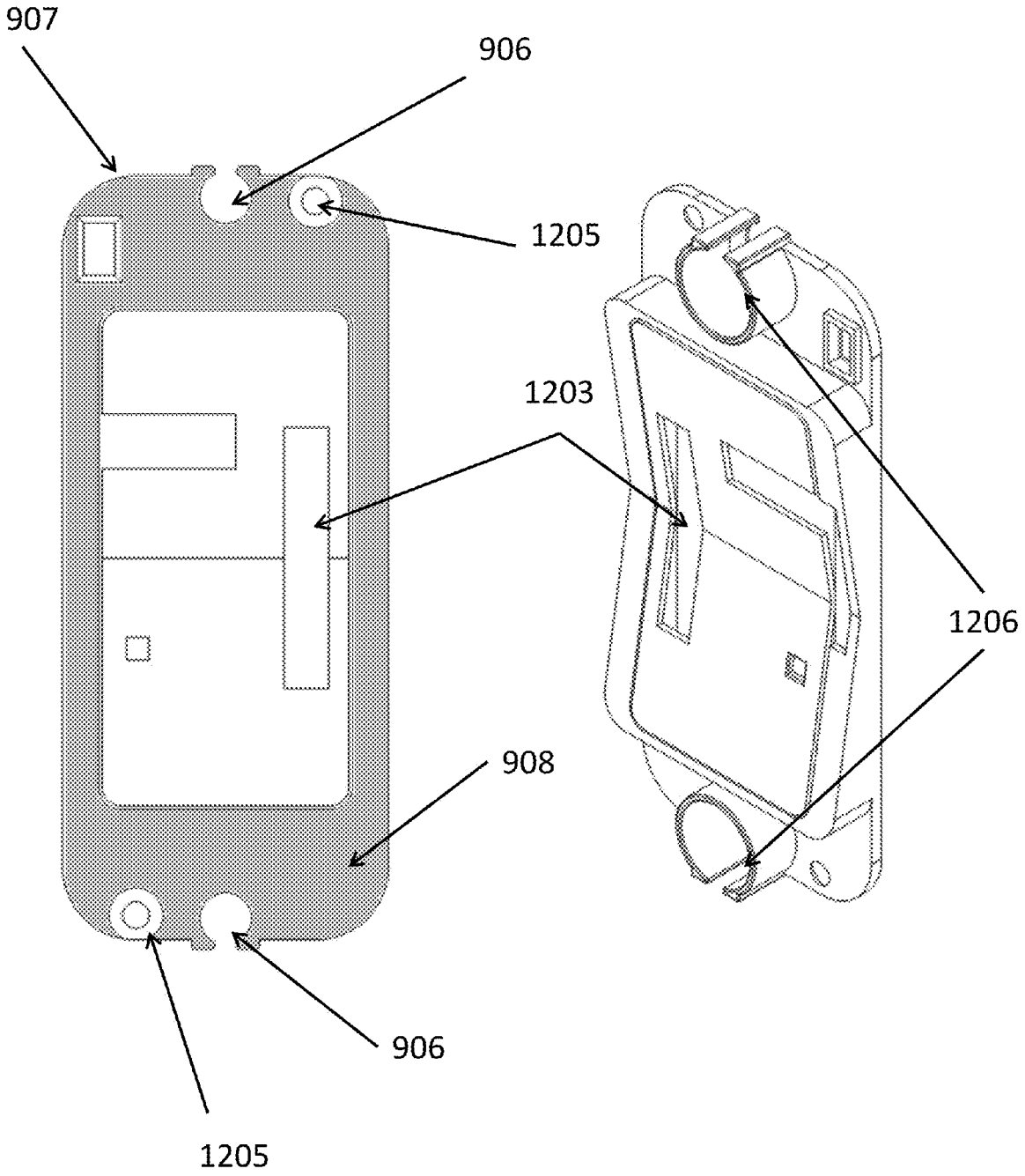
FIG. 12 shows the posterior and perspective view of the back cover for version B of the present invention.

FIG. 12 shows the posterior and perspective view of the backing plate for version B of the present invention. Similarly, two apertures 1205 allow this backing plate to be mounted to the frontal cover with screws. Compartments 1206 are for the placement of neodymium magnets to contact the metal screws on the pre-existing fixture. Apertures 906 allow for this direct contact between the magnets and metal screws.

With communication protocols such as Bluetooth, Bluetooth Low Energy, and Zigbee, it is possible to control the automation device from a maximum range of approximately 150 meters. In order to increase the range of the automation device beyond this range, the device can incorporate a wireless local area network module, such as WiFi, or communicate to a wireless gateway with wireless local area network capabilities. It would then be possible to send commands to the automation device from any device capable of joining this wireless local area network, regardless of distance. These commands can include scheduling timers, requests for status of the state of the lever, and toggling of the state of the lever. As mentioned earlier, the state of the lever is known because the microcontroller is able to keep track of the last command received.

In addition, if a wireless gateway is capable of communicating with three or more automation devices, it would be able utilize a technique known as trilateration to create a physical map of the position of other wireless devices within range. As an example, each of the three automation devices would provide the gateway with their respective signal strength to a smart phone. Using these three values with the trilateration algorithm, the gateway would be able to approximate the relative location of the smart phone, effectively creating an indoor positioning system. Based on this information, it could send commands to the automation devices such as toggling the state of the switch they automate. An example of how this can be used would be that the user can implement logic through a smartphone such that if the user is near two automation devices (e.g. RSSI value >−50 dBm) and further from the third (e.g. RSSI value <−70 dBm), the gateway can send a command to have the third automation device toggle the state of the pre-existing fixture to turn lights off. The RSSI threshold values for this logic can be set by the user or set to default values.

While this system has been described to communicate with the Bluetooth Low Energy protocol, it need not be limited to this and could operate with a protocol more suited for a mesh network such as Zigbee or Z-wave. This would allow multiple automation devices to communicate with one another and effectively increase the range of communication to send and receive commands. Since the devices are capable of communicating with one another, they could provide signal strength values to one another and create an indoor positioning system without the need of a wireless gateway, as described in the previous paragraph. As an example, two automation devices could provide their respective measured signal strength to a smart phone to a third automation device. This third automation device could then use these two values, in addition to its own measured signal strength, and apply the trilateration algorithm to map the location of the smartphone. As mentioned in the previous paragraph, the user can implement logic to toggle the state of the pre-existing fixture based on measured RSSI values.

If the automation device is used with a smartphone or web portal, the user has the ability to name each automation device on the smartphone app and/or web portal. If the user were to use a name such as "front door" or "back yard", the app can make the assumption that the automation devices have been installed near the front and back of the house, respectively. A third device which does not have any keywords such as "front" or "back" can be assumed to be between two such devices. To prevent false positives, the user can also provide the app with the approximate distance of the device from the front of the house. With this information, it is possible to provide the relative location of another Bluetooth or Zigbee device within the home. As an example, it would be possible to calculate the approximate location of a child, wearing a Bluetooth low energy bracelet, within a home.

Figure 13:
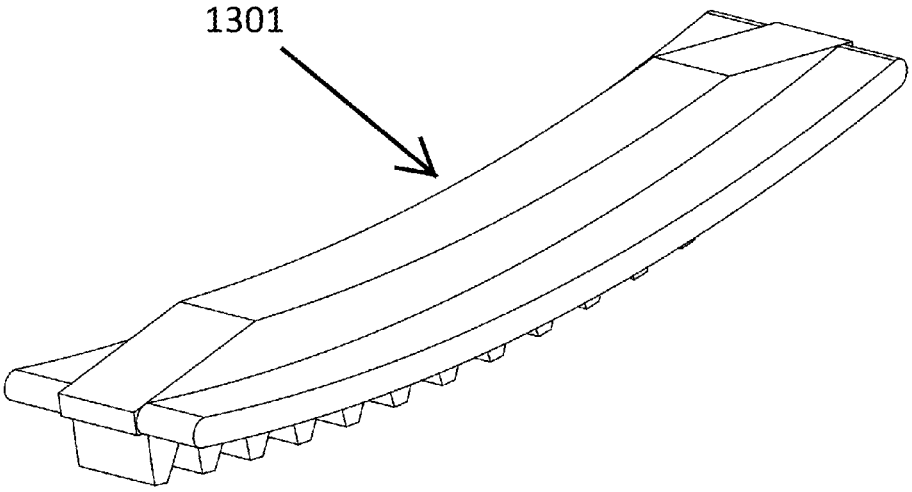
FIG. 13 shows a bowed rack according to an alternative embodiment of version B.

An alternative embodiment of version B of the automation device replaces rotational head 1101 with a curved or bowed rack driven by a pinion in a rack and pinion mechanism functionally operating in a similar fashion to the rack and pinion mechanism of version A of the automation device. Referring now to FIG. 13, an example embodiment of such a curvilinear or bowed rack is shown having pinion matching teeth on a side opposite from that of the direction of the bow. In this alternative embodiment of version B, which is to be used with a rocker switch as has been described, the curved or bowed rack 1301 is moved by a toothed or geared pinion such that ends of the curved or bowed rack 1301 contact the lever of the rocker switch in order to toggle the rocker switch between an on and off state.

Figure 14:
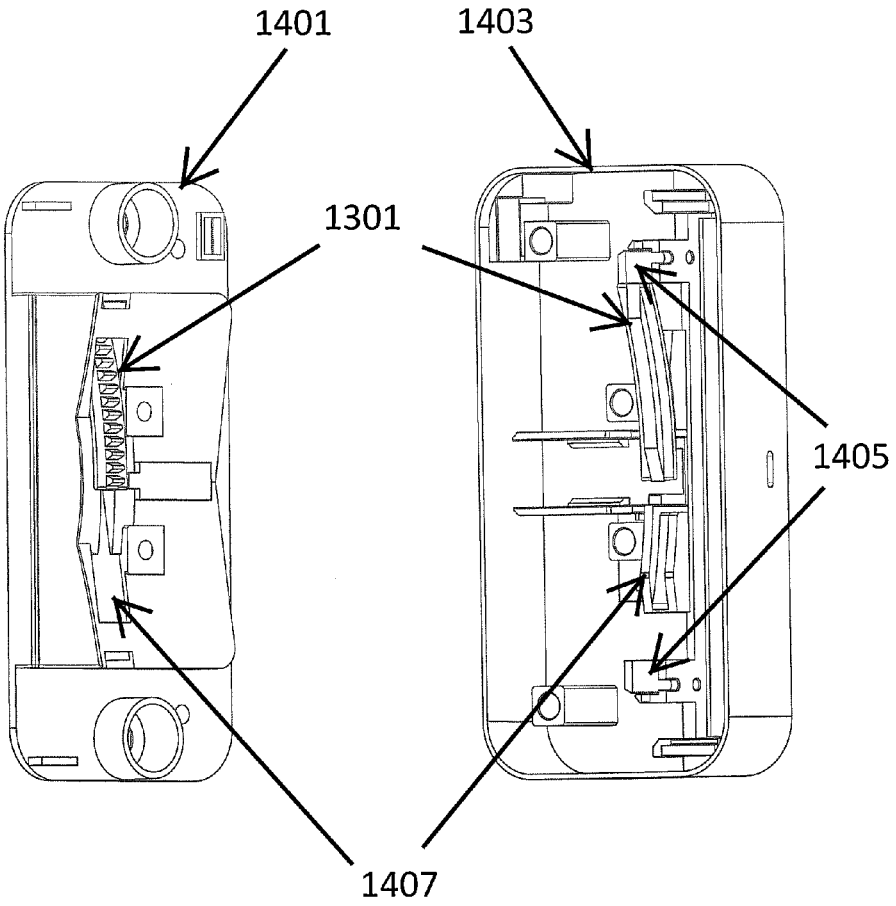
FIG. 14 shows the bowed rack and housing configuration according to the alternative embodiment of version B.

This operation can more readily be seen in FIG. 14 where front portion 1403 and back portion 1401 of the automation device housing, which when combined contains or holds the bowed rack 1301, can be seen. In particular, the pinion moves the bowed rack 1301, along and between curvilinear guides 1407 of front portion 1403 and back portion 1401 of the automation device housing, thereby causing ends of the bowed rack 1301 to extend in a rearward direction from the automation device housing and towards the lever of the rocker switch. Moving the bowed rack 1301 in one direction thus causes one end to flip the lever of the rocker switch into an "on" state and moving the bowed rack 1301 in the opposite direction thus causes an opposite end to flip the lever of the rocker switch into an "off" state.

Further, as also shown in the figure, this embodiment of version B of the automation device includes limit switches 1405 which are contacted by the ends of bowed rack 1301 as bowed rack 1301 is moved between these two positions or states. The limit switches 1405 are coupled to the microcontroller 502 in order to send a signal to microcontroller 502 when one end of bowed rack 1301 contacts one of the limit switches 1405 thereby informing microcontroller 502 that the bowed rack 1301 has reached an end position (equivalent to the 0° position or 180° position described above with reference to version A of the automation device). Upon receipt of this signal, microcontroller 502 directs that the pinion stop moving bowed rack 1301 in its current direction and, instead, briefly reverse its direction in order to return bowed rack 1301 to an offset position from the end position, to achieve the same effect as was described above with reference to version A of the automation device.

It is to be understood that version A of the automation device can likewise incorporate limit switches 1405 to be contacted by ends of rack 405, the linear actuator of version A, to thereby operate in essentially the same fashion as described above with reference to the alternative embodiment of version B of the automation device.

In a still further embodiment of either version A or version B of the automation device the servomechanism portion of the actuator mechanism can be replaced by a direct current (DC) motor to drive the pinion of the rack and pinion mechanism. This DC motor based arrangement, while functionally similar to that of the servomechanism based arrangement, can be used in conjunction with the limit switches 1405 as will now be described. When the automation device is powered on (e.g., via toggle switch 407), the DC motor directs the pinion to move the rack until one of the limit switches sends a signal to the microprocessor that the rack has made contact with it. Then the microcontroller 502 directs the DC motor to reverse direction for a predetermined period of time, based on the known revolutions per minute (RPM) of the DC motor, to cause the rack to be placed in a neutral or center position of the automation device. This places the rack opening, for version A of the automation device, or the bowed rack, for the alternative embodiment of version B of the automation device, in a middle or intermediate position most easily placed by a user over the lever of the light switch without unintentionally flipping the light switch. The user is instructed to place the automation device on the light switch in an up position (as may be indicated by a visual marker on the automation device) after this power up sequence. Thereafter, any command received by the microcontroller 502 to either flip the switch on or off results in the microcontroller signaling the DC motor to cause the pinion to move the rack in the appropriate direction (e.g., up for on and down for off) until one of the limit switches 1405 signals the microcontroller 502 that the rack has made contact with it, thereby indicating that the rack has reached an end position, at which point the microcontroller signals the DC motor to reverse direction for a brief period of time thereby placing the rack in the offset position, as was described above. It is to be understood that mechanisms such as solenoids, stepper motors and Shape Memory Alloys (SMAs) can likewise be used in place of the DC motor.

In a further embodiment, a time out operation is used with the above-described process to prevent possible damage to components of the automation device as well as achieve potential power savings. For example, with some physically large light switch levers, the rack may not be able to move far enough to contact one of the limit switches despite already having moved far enough to flip the light switch. Not receiving an end position signal from a limit switch could cause the microcontroller to continue directing the DC motor to move the pinion until either the DC motor burns out or the rack and pinion mechanism breaks and also continues to consume power running the DC motor. This is avoided in this further embodiment where, starting from the intermediate power up position, the microcontroller stops signaling the DC motor to cause the pinion to move the rack upon either receiving the limit switch signal or a first time out period has elapsed, whichever occurs first. The first time out period would typically be the amount of time, again based on the known RPMs of the DC motor, expected to move the rack from the intermediate position to the end position. A second time out period, approximately twice as long as the first time out period because the rack's length of travel is approximately twice as long when going from one end position (or the offset position) to the other end position, would then be used for any later switching operations between the on and off states of the light switch.

In a further alternative embodiment, one or more additional sensors are included within the automation device to detect presence of a user. Any known sensor can be used including a motion sensor, a temperature sensor, a humidity sensor, a camera, etc. Such sensor can then signal to the microcontroller that a user is present thereby causing the microcontroller to turn on the switch.

The disclosed method and apparatus has been explained above with reference to several embodiments. Other embodiments will be apparent to those skilled in the art in light of this disclosure. Certain aspects of the described method and apparatus may readily be implemented using configurations other than those described in the embodiments above, or in conjunction with elements other than those described above. For example, different components, algorithms and/or logic circuits, perhaps more complex than those described herein, may be used. Further, as would be understood by one of skill in the art in light of the description herein, use of the automation device is not limited to controlling a pre-existing switch electrically coupled to a light fixture and can also control a pre-existing switch electrically coupled to any electrical apparatus or component. As such, any reference herein to the automation device being a light switch automation device or to the pre-existing switch being a light switch should not be interpreted to limit use with a switch electrically coupled to a light fixture.

Further, it should also be appreciated that the described method and apparatus can be implemented in numerous ways, including as a process, an apparatus, or a system. The methods described herein may be implemented by program instructions for instructing a processor to perform such methods, and such instructions recorded on a non-transitory computer readable storage medium such as a hard disk drive, floppy disk, optical disc such as a compact disc (CD) or digital versatile disc (DVD), flash memory, etc., or communicated over a computer network wherein the program instructions are sent over optical or electronic communication links. It should be noted that the order of the steps of the methods described herein may be altered and still be within the scope of the disclosure.

It is to be understood that the examples given are for illustrative purposes only and may be extended to other implementations and embodiments with different conventions and techniques. While a number of embodiments are described, there is no intent to limit the disclosure to the embodiment(s) disclosed herein. On the contrary, the intent is to cover all alternatives, modifications, and equivalents apparent to those familiar with the art.

In the foregoing specification, the invention is described with reference to specific embodiments thereof, but those skilled in the art will recognize that the invention is not limited thereto. Various features and aspects of the above-described invention may be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. A light switch automation device comprising:

a self-aligning housing having rear-facing magnetic material in locations corresponding to metallic screw heads of a cover plate for a light switch;

an actuator located within the housing, the actuator configured to actuate a lever of the light switch once the light switch automation device has been placed on the light switch cover plate; and a microcontroller located within the housing, the microcontroller configured to control the actuator.

2. The light switch automation device of claim 1 wherein the actuator comprises a servomechanism.

3. The light switch automation device of claim 1 wherein the actuator comprises a direct current (DC) motor.

4. The light switch automation device of claim 1 wherein the actuator comprises a rack and pinion mechanism.

5. The light switch automation device of claim 4 wherein the rack of the rack and pinion mechanism is linear and has edges configured to contact a lever of a toggle type light switch.

6. The light switch automation device of claim 4 wherein the rack of the rack and pinion mechanism is linear and has an opening configured to surround a lever of a toggle type light switch.

7. The light switch automation device of claim 1 wherein the actuator comprises a rotational head to contact a rocker of a rocker type light switch.

8. The light switch automation device of claim 4 wherein the rack of the rack and pinion mechanism is bowed to contact a rocker of a rocker type light switch.

9. The light switch automation device of claim 1 wherein the housing further comprises a button input coupled to the microcontroller to signal to the microcontroller to control the actuator.

10. The light switch automation device of claim 1 further comprising a wireless communication module located within the housing, the wireless communication module configured to wirelessly receive a signal and communicate the received signal to the microcontroller.

11. The light switch automation device of claim 10 wherein the received signal is a signal to control the actuator.

12. The light switch automation device of claim 10 wherein the received signal is from a smartphone.

13. The light switch automation device of claim 10 wherein the received signal includes a power level from which the microcontroller can determine a distance between the light switch automation device and a sender of the received signal.

14. The light switch automation device of claim 1 wherein the self-aligning housing having rear-facing magnetic material in locations corresponding to metallic screw heads of the light switch cover plate further comprises apertures in a back of the self-aligning housing, the apertures spaced apart to match placement of the metallic screw heads of the light switch cover plate and the apertures chamfered to match a hemispherical shape of the metallic screw heads.

15. The light switch automation device of claim 1 further comprising a material located on a back of the self-aligning housing, the material providing a frictional force between the back of the self-aligning housing and the light switch cover plate that is greater than or equal to a force required to actuate the lever of the light switch.

16. The light switch automation device of claim 1 wherein the microcontroller configured to control the actuator is further configured to control the actuator to move to a center position upon power up of the light switch automation device.

17. The light switch automation device of claim 1 wherein the microcontroller configured to control the actuator is further configured to control the actuator to move to an end position, thereby actuating the light switch lever, when the microcontroller receives a signal to actuate the light switch.

18. The light switch automation device of claim 17 wherein the microcontroller configured to control the actuator to move to an end position is further configured to control the actuator to move to an offset position from the end position after controlling the actuator to move to the end position.

19. The light switch automation device of claim 1 further comprising a limit switch located within the housing configured to send a signal to the microcontroller when the actuator makes contact with the limit switch.

20. The light switch automation device of claim 1 wherein the microcontroller configured to control the actuator is further configured to control the actuator to stop moving when the microcontroller has determined that a stall current of the actuator has reached a predetermined limit.

21. The light switch automation device of claim 20 wherein the microcontroller configured to control the actuator to stop moving when the microcontroller has determined that a stall current of the actuator has reached a predetermined limit is further configured to control the actuator to move to an offset position from an end position.

* * * * *